US012601567B2

(12) United States Patent
Morell et al.

(10) Patent No.: US 12,601,567 B2
(45) Date of Patent: Apr. 14, 2026

(54) VIEWING OPTIC WITH IMPACT ABSORPTION MATERIAL

(71) Applicant: Sheltered Wings, Inc., Barneveld, WI (US)

(72) Inventors: Rob Morell, Barneveld, WI (US); Seth Toy, Barneveld, WI (US); Kellen Beauchene, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

(21) Appl. No.: 17/586,323

(22) Filed: Jan. 27, 2022

(65) Prior Publication Data

US 2022/0244020 A1 Aug. 4, 2022

Related U.S. Application Data

(60) Provisional application No. 63/143,204, filed on Jan. 29, 2021.

(51) Int. Cl.
*F41G 1/34* (2006.01)
*F41G 11/00* (2006.01)

(52) U.S. Cl.
CPC ..... *F41G 11/00* (2013.01); *F41G 1/345* (2013.01)

(58) Field of Classification Search
CPC ... F41G 1/065; F41G 1/08; F41G 1/14; F41G 1/30; F41G 1/345; F41G 11/00
USPC ..... 42/130
See application file for complete search history.

(56) References Cited

U.S. PATENT DOCUMENTS 4,554,744 A 11/1985 Huckenbeck
8,713,807 B2 * 5/2014 LoRocco ..... F41G 1/345 362/110
10,139,197 B1 * 11/2018 Horton ..... F41G 1/383
2013/0145666 A1 * 6/2013 Eriksson ..... F41G 11/002 42/1.06
2014/0237884 A1 * 8/2014 Koesler ..... F41G 1/345 42/111
2016/0069644 A1 3/2016 Bell
2016/0327366 A1 11/2016 Campean
2018/0017356 A1 1/2018 Cabrera et al.
2019/0360777 A1 11/2019 Grace et al.
2020/0025516 A1 1/2020 Mok
(Continued)

FOREIGN PATENT DOCUMENTS

CN 211234126 U 8/2020

OTHER PUBLICATIONS

International Search Report and Written Opinion for International Application No. PCT/US22/14090 dated Apr. 26, 2022, 12 pages.
(Continued)

*Primary Examiner* — Troy Chambers
*Assistant Examiner* — Benjamin S Gomberg
(74) *Attorney, Agent, or Firm* — Husch Blackwell LLP

(57) ABSTRACT

A viewing optic has a base and a housing. The housing has a front side, a rear side, a left side, a right side and a top side. The front side, rear side, left side and right side extend upwardly from the base. The top side extends between the upper edges of the front side, rear side, left side and right side. A load absorbing/dispersing component is on at least a portion of the top side. The load absorbing/dispersing component comprises a load absorbing/dispersing material.

6 Claims, 9 Drawing Sheets

(56) References Cited

U.S. PATENT DOCUMENTS

| | | | | |
|---|---|---|---|---|
| 2020/0232759 | A1* | 7/2020 | York | F41G 1/30 |
| 2020/0278177 | A1 | 9/2020 | Grace | |
| 2021/0156646 | A1* | 5/2021 | Schulte | F41G 1/16 |
| 2021/0207928 | A1* | 7/2021 | Brewer | F41G 1/16 |
| 2022/0026175 | A1* | 1/2022 | Chavez | F41G 1/30 |
| 2022/0244020 | A1* | 8/2022 | Morell | F41G 11/00 |

OTHER PUBLICATIONS

International Preliminary Report on Patentability for International Application No. PCT/US22/14090 dated Jul. 31, 2023, 6 pages.
Extended European Search Report for European Patent Application No. 22746601.8 issued Nov. 8, 2024, 8 pages.

* cited by examiner

VIEWING OPTIC WITH IMPACT ABSORPTION MATERIAL

CROSS REFERENCE TO RELATED APPLICATIONS

This application is a non-provisional patent application of and claims priority to U.S. Provisional Patent Application No. 63/143,204 filed Jan. 29, 2021, which is incorporated herein by reference in its entirety.

FIELD

The disclosure relates to a viewing optics. In one embodiment, the disclosure relates to a viewing optic containing a load-absorbing/dispersing material. In one embodiment, the disclosure relates to a miniature red dot sight for a firearm containing a load-absorbing/dispersing material.

BACKGROUND

Miniature red dot sights (MRDSs) are non-magnifying reflector sights generally used with small firearms such as handguns and pistols. MRDSs use a reflective optical system to project light toward the user to see the target field and the illuminated red dot reticle. MRDSs can be either enclosed, in which all of the optical elements are completely encased by a housing, or open, in which at least a portion of the optical elements are not encased by a housing.

One issue encountered with a MRDS is that the MRDS can be damaged if the firearm to which it is attached is dropped, particularly when the firearm is heavy, like a pistol. The substantial mass of the firearm often causes the red dot optical element to either shift, break, or both. This can adversely affect the shooter's accuracy. As the MRDS is small, there is limited space to include design features to mitigate the issue of damage. Even with larger viewing optics and viewing optics that do not attach to firearms, optical elements can be damaged with the impact of a fall, and it is not always aesthetically practical to include structural elements that mitigate this issue.

For the reasons discussed above, providing a material to absorb and/or disperse the force of an impact on a viewing optic is a big advantage.

SUMMARY

In one embodiment, the disclosure provides a viewing optic. In accordance with embodiments of the disclosure, a viewing optic comprises a base; a housing comprising a front side, a rear side, a left side, a right side and a top side, wherein the front side, rear side, left side and right side extending upwardly from the base, and wherein the top side extends between upper edges of the front side, rear side, left side and right side; and a load absorbing/dispersing component on at least a portion of the top side.

In an embodiment, the load absorbing/dispersing component comprises at least one load absorbing/dispersing material. In a further embodiment, the load absorbing/dispersing material is selected from the group consisting of a rubber, a gel, a foam, a plastic, a polymeric material, a non-Newtonian material and combinations thereof. In yet a further embodiment, the top side has a recess and the at least one load absorbing/dispersing component is positioned in the recess. In accordance with another embodiment, the at least one load absorbing/dispersing component is flush with an upper surface of the top side. In another embodiment, the at least one load absorbing/dispersing component extends beyond an upper surface of the top side. In a further embodiment, the load absorbing/dispersing component at least partially covers an upper surface of the top side.

In an embodiment, the viewing optic further comprises at least one control on one of the left side, right side and base. In a further embodiment, the at least one control is in communication with at least one actuation structure. In yet a further embodiment, the at least one actuation structure passes through the top side. In an embodiment, the at least one load absorbing/dispersing component is in contact with the at least one actuation structure.

In another embodiment, the disclosure provides a firearm. In accordance with embodiments of the disclosure, a firearm comprises a viewing optic, the viewing optic having a base; a housing having a front side, a rear side, a left side, a right side and a top side; and at least one load absorbing/dispersing component on at least a portion of the top side.

In an embodiment, the viewing optic is a miniature red dot sight. In another embodiment, the firearm is a handgun.

In an embodiment, the load absorbing/dispersing material is selected from the group consisting of a rubber, a gel, a foam, a plastic, a polymeric material, a non-Newtonian material and combinations thereof. In another embodiment, the top side has a recess and the at least on load absorbing/dispersing material is positioned in the recess. In a further embodiment, the load absorbing/dispersing material at least partially covers the top side. In yet another embodiment, the viewing optic further includes at least one control on one of the left side, right side and base. In a further embodiment, the at least one control is in communication with at least one actuation structure, wherein the at least one actuation structure passes through the top side and the at least one load absorbing/dispersing material is in contact with the at least one actuation structure.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

Figure 1:
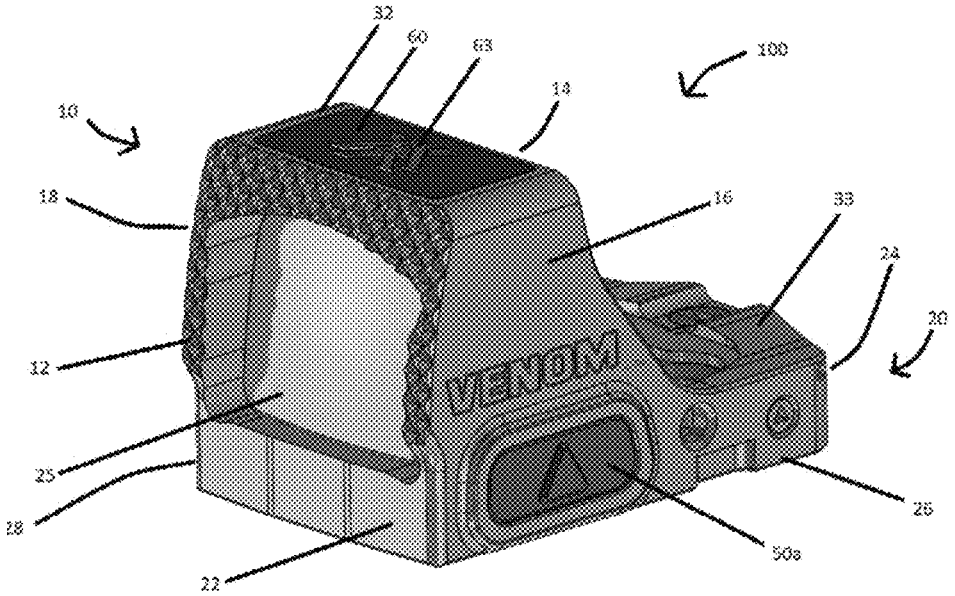
FIG. 1 is a representative depiction of a first embodiment of an MRDS having a load absorbing/dispersing material in accordance with embodiments of the disclosure.
Figure 2:
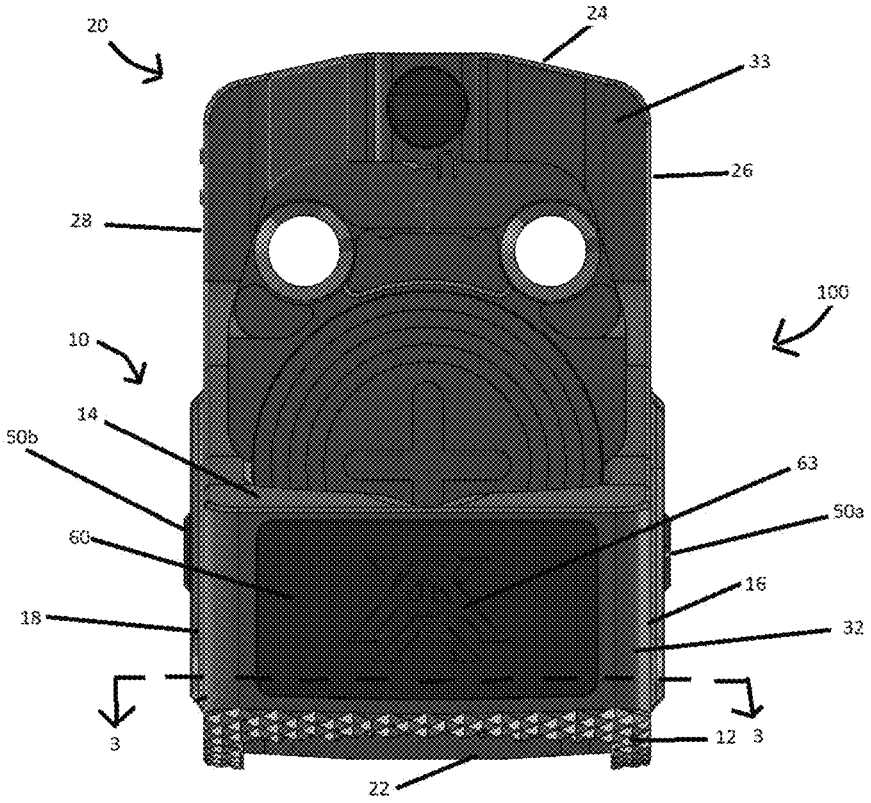
FIG. 2 is a top view of the MRDS of FIG. 1.

Before explaining embodiments of the disclosure in detail, it is to be understood that the disclosure is not limited in its application to the details of construction and the arrangement of the components set forth in the following description or illustrated in the drawings. The technology of this disclosure is capable of other embodiments or being practiced or carried out in various ways. Also, it is to be understood that the phraseology and terminology employed herein is for the purpose of description and should not be regarded as limiting.

DETAILED DESCRIPTION

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, melt index, temperature, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure.

Spatial terms, such as "beneath," "below," "lower," "above," "upper," and the like, may be used herein for ease of description to describe one element's or feature's relationship to another element(s) or feature(s) as illustrated in the figures. It will be understood that the spatially relative terms are intended to encompass different orientations of device in use or operation in addition to the orientation depicted in the figures. For example, if the device is turned over, elements described as "below" or "beneath" other elements or features would then be orientated "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the term "and/or" includes any and all combinations of one or more of the associated listed terms. For example, when used in a phrase such as "A and/or B," the phrase "and/or" is intended to include both A and B; A or B; A (alone); and B (alone). Likewise, the term "and/or" as used in a phrase such as "A, B and/or C" is intended to encompass each of the following embodiments: A, B and C; A, B, or C; A or C; A or B; B or C; A and C; A and B; B and C; A (alone); B (alone); and C (alone).

It will be understood that when an element or layer is referred to as being "on," "connected to," or "coupled to" another element or layer, it can be directly on, connected to or coupled to the other element or layer. Alternatively, intervening elements or layers may be present. In contrast, when an element or layer is referred to as being "directly on," "directly connected to," or "directly coupled to" another element or layer, there are no intervening elements or layers present.

As used herein, a "load absorbing/dispersing material" refers to any material that can absorb a force and/or direct a force in a desired direction. Exemplary load absorbing/dispersing materials include, but are not limited to, rubbers, gels, foams, plastics, polymeric materials, non-Newtonian materials, and combinations of these materials.

As used herein, a "recess" is an aperture, cavity, chamber, groove, notch, slit, slot, opening, ridge, hole, or other such volume void of a first material and into which a second material may be inserted.

In one embodiment, the disclosure relates to assembly that includes a sight body, optical element, and load absorbing/dispersing component. In one embodiment, the load absorbing/dispersing component is one or more load absorbing/dispersing materials located on the top side of the sight body. In another embodiment, the disclosure relates to an assembly that includes a sight body with a right side, left side, front side, rear side and top side, an optical element and a load absorbing/dispersing component located on the top side of the sight body. In a further embodiment, the load absorbing/dispersing component is one or more load absorbing/dispersing materials located on the top side of the sight body. In still a further embodiment, the load absorbing/dispersing component is one or more load absorbing/dispersing materials located on the top side of the sight body positioned in one or more recess on the top side of the sight body.

FIG. 1 illustrates an exemplary viewing optic 100 having a load absorbing/dispersing component 60 in accordance with embodiments of the disclosure. In the particular embodiments shown and described herein, the viewing optic 100 is a MRDS, and for purposes of this disclosure "viewing optic" and "MRDS" may be used interchangeably. When mounted to a firearm, the viewing optic displays a reticle to facilitate alignment of a trajectory of the firearm with a target.

In the embodiment shown, the viewing optic 100 has a housing 10 and a base 20. The housing 100 has a front side 12, rear side 14, left side 16, right side 18 and top side 32. The front side 12, rear side 14, left side 16, and right side 18 extend generally upwardly from the base 20. The front side 12 and rear side 14 extend between the left side 16 and right side 18. The top side 32 extends between the upper edges of each of the front side 12, rear side 14, left side 16, and right side 18. The resulting housing 10 contains the illumination system and other components that make the viewing optic functional. An optical element 25, in this case a lens, is contained in the front side 10*a*, and the viewing optic is an "open" MRDS. In further embodiments, a rear transparent cover (not shown), such as glass, may be contained in the rear side 10*b*, and the viewing optic is a closed MRDS. The base 20 also includes an attachment means (such as a mounting screw) and various adjustment devices (such as adjustment screws), which are not shown in the Figures for clarity. Similarly, a battery would also be secured in the housing 10 and protected by a battery cap, though the battery and battery cap are not shown for clarity.

Turning specifically to the base 20, the base 20 has a front side 22, rear side 24, left side 26, right side 28 and upper surface 33. The left side 16 and right side 18 of the housing appear as legs extending upward from the left side 26 and right side 28 of the base, respectively.

As shown with reference to FIGS. 1-4, the controls 50*a* and 50*b* are positioned on the left side 26 and right side 28 of the base 20 respectively. In further embodiments, a single control on a single side (i.e., either the left side 26 or right side 28) may be provided. As shown in FIGS. 1-4, the left side 26 and right side 28 each include a recess 52 into which the controls 50*a*, 50*b* are positioned. In the embodiment shown, the recesses 52 and associated controls 50*a*, 50*b* are entirely on the base 20, while in other embodiments all or a portion of the recesses 52 and/or controls 50*a*, 50*b* extend on to the left side 26 and/or right side 28, as appropriate.

In the embodiment shown, each of the controls 50*a*, 50*b* is provided as two depressible buttons. In a particular embodiment, one of the two depressible buttons (that is, button 50*a* or button 50*b*) is configured to increase the brightness of the viewing optic 100 and the other is configured to decrease the brightness of the viewing optic 100. Moreover, in the particular embodiment shown, both controls 50*a*, 50*b* are identical, meaning they control the same property of the viewing optic in the same manner. However, in further embodiments, the controls 50*a*, 50*b* may be any type of adjustment means or combination of adjustment means, such as, for example, depressible buttons, toggles, knobs, slides, etc. Further, the control may include any number of such adjustment means, including but not limited to a single control, or more than two controls. Similarly, one or more of the controls 50*a*, 50*b* may be configured to adjust a property of the viewing optic other than brightness, and the controls 50*a*, 50*b* may be configured to control different properties.

In an embodiment, the controls 50*a*, 50*b* comprise a portion of elastomeric material, or rubber-like material. As shown in the Figures, in such an embodiment, the controls 50*a*, 50*b* each comprise a portion of a rubber or silicone material contained a recess 52 on a respective side 26, 28 of the base 20. It will be appreciated that the recesses contain the mechanisms which are in electrical communication with the internal mechanisms that control the particular property being adjusted, which in the present embodiment is brightness.

By positioning controls 50*a*, 50*b* on both sides 26, 28 of the base 20, right-handed and left-handed users can equally utilize the viewing optic without having to utilize a non-dominant hand. Furthermore, because the controls 50*a*, 50*b* as shown in the Figures each include two adjustment means, multiple directions of control or multiple properties may be adjusted with a single control 50*a*, 50*b*. This is in direct contrast to providing a single control on a side of the housing. Also, positioning the controls 50*a*, 50*b* on the sides 26, 28 of the base 20 ensures that the controls 50*a*, 50*b* are not blocked or crowded by other structures, allowing a user to easily access the controls 50*a*, 50*b* even while wearing gloves.

Positioning a control 50*a*, 50*b* on both sides 26, 28 of the base 20 of the housing 10 also allows a user to make adjustments with the firearm in its holster, which is not always possible with controls positioned on a single side of a viewing optic. For example, if a competition shooter wants to make a brightness adjustment to compensate for some incoming cloud cover, the shooter is not able to remove the firearm from the holster to make this adjustment per the rules of the match, but would still be able to make the adjustment with the viewing optic 100 disclosed herein.

Figure 3:
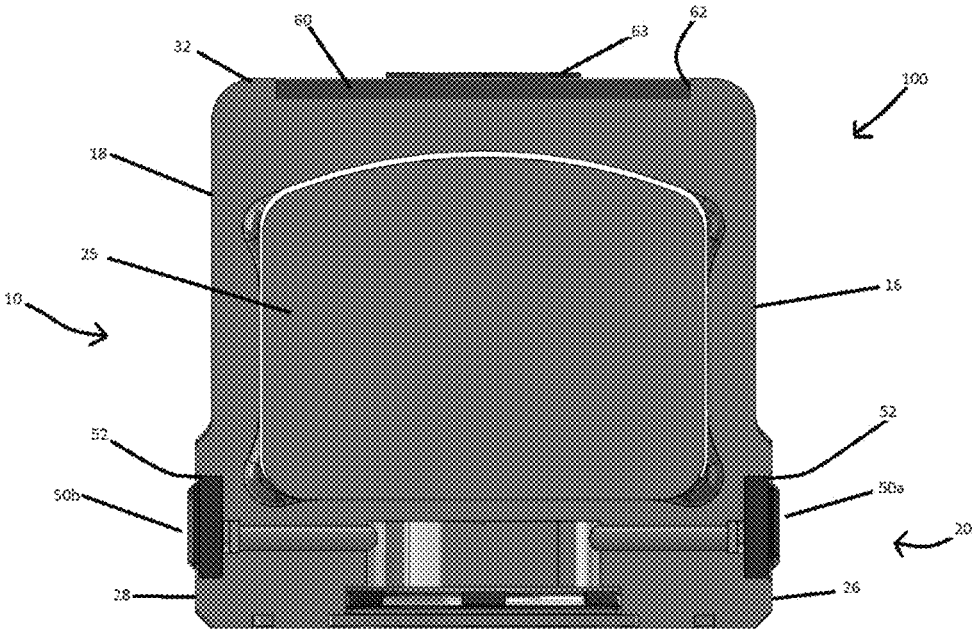
FIG. 3 is a cross-sectional view of the MRDS of FIG. 2 taken along line 3-3.
Figure 4:
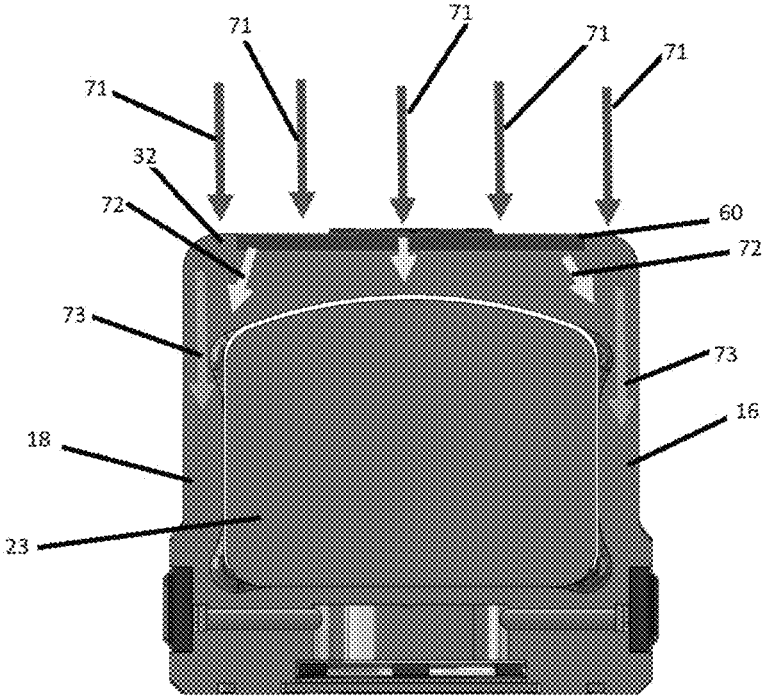
FIG. 4 is a representative illustration of the MRDS of FIG. 3 demonstrating how the forces are redirected from the optical element.

With reference to FIGS. 3 and 4, shown is the load absorbing/dispersing component 60. In the embodiment shown, the load absorbing/dispersing component 60 is positioned on the top side 32 of the housing 10. More particularly, as shown in FIGS. 3 and 4, the top side 32 of the housing includes a recess 62 and the load absorbing/dispersing component 60 is provided as a single element of load absorbing/dispersing material contained within the recess 62. In further embodiments, the load absorbing/dispersing component 60 may be multiple pieces of load absorbing/dispersing material, and the multiple pieces of load absorbing/dispersing material may be provided in a single recess or multiple recesses on the top side 32 of the housing 10.

In the embodiment shown in FIGS. 3 and 4, the load absorbing/dispersing component 60 is primarily flush with the upper surface of the top side 32, with the exception of the optional logo/product indicia 63 provided on the surface of the load absorbing/dispersing component 60. However, in other embodiments, a portion of the load absorbing/dispersing component 60 may extend above the upper surface of the top side 32.

Referring now to FIG. 4, shown is representative depiction showing how an impact is absorbed by the load absorbing/dispersing component 60 and redirected away from the optical element 10. The force of the impact is illustrated with arrows 71. Where the impact directly contacts the portions of the top side 32 not containing the load absorbing/dispersing component 60, the force of the impact is transferred down the sides 16, 18 of the housing, as shown by arrows 72. Where the impact directly contacts load absorbing/dispersing component, however, the force of the impact is dampened and spread across the top side 32 to the sides 16, 18 and away from the optical element 25, as shown by arrows 73. The load absorbing/dispersing effect is due to Newton's second law of motion and the material of the load absorbing/dispersing component 60. In a collision, if the time of the impact is increased, such as by providing a load absorbing/dispersing material, the force experience is reduced. The load absorbing/dispersing component 60, which is one or more elements or pieces of load absorbing/dispersing material such as rubbers, foams, etc., as described above, absorbs a portion of the impact load so the optical element 25 does not experience the full force of the impact.

FIGS. 5A-5E and 6A-6F illustrate further embodiments of a viewing optic in accordance with the embodiments of the disclosure.

In the embodiment shown in FIGS. 5A-5E, the load absorbing/dispersing component 60' is a single piece of load absorbing/dispersing material situated in a recess 62' as shown with respect to the viewing optic 100 of FIGS. 1-4. However, in the embodiment shown in FIGS. 5A-5E, the controls 50*a*' and 50*b*' of viewing optic 100' are positioned on the left side 16' and right side 18' of the housing 10 respectively. The controls 50*a*' and 50*b*' may be in accordance with any embodiment or combination of embodiments described herein.

Figure 5A:
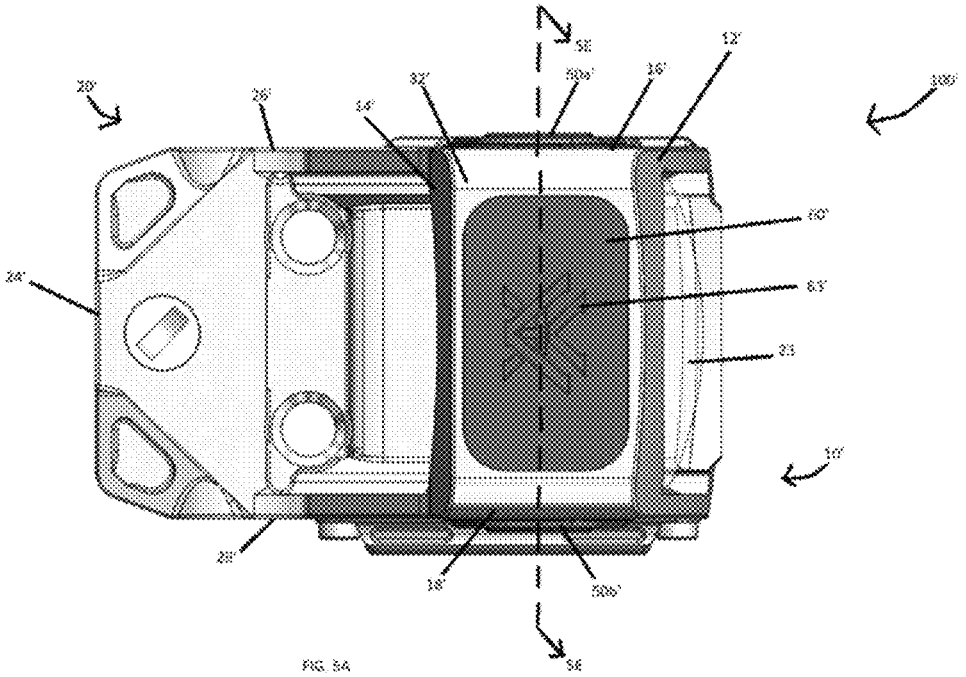
FIG. 5A is a top view of a second embodiment of an MRDS having a load absorbing/dispersing material in accordance with embodiments of the disclosure.
Figure 5B:
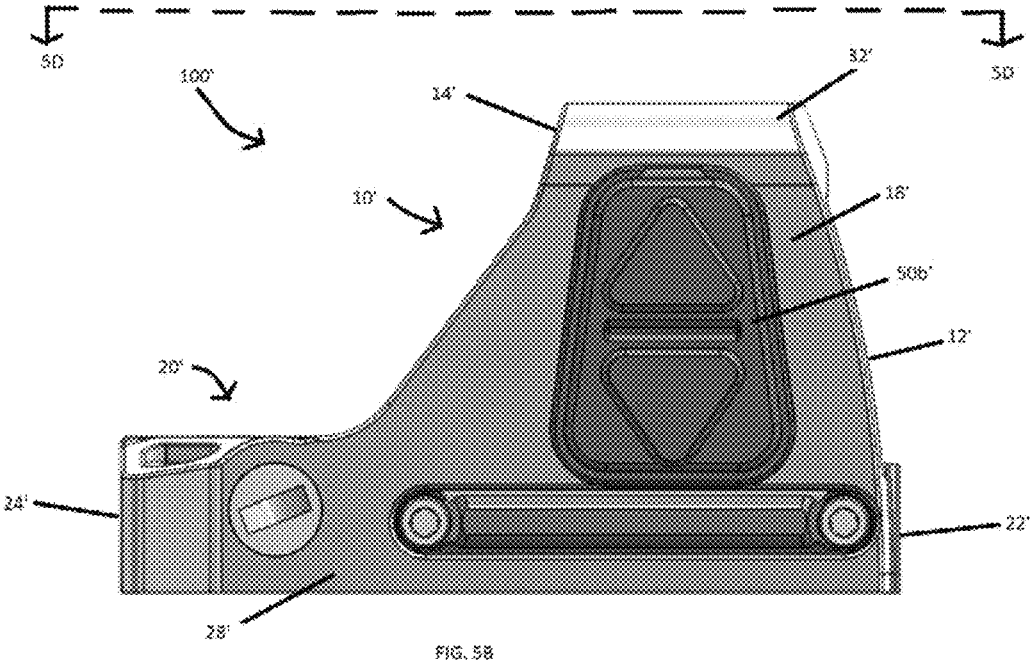
FIG. 5B is a right side view of the MRDS of FIG. 5A.
Figure 5C:
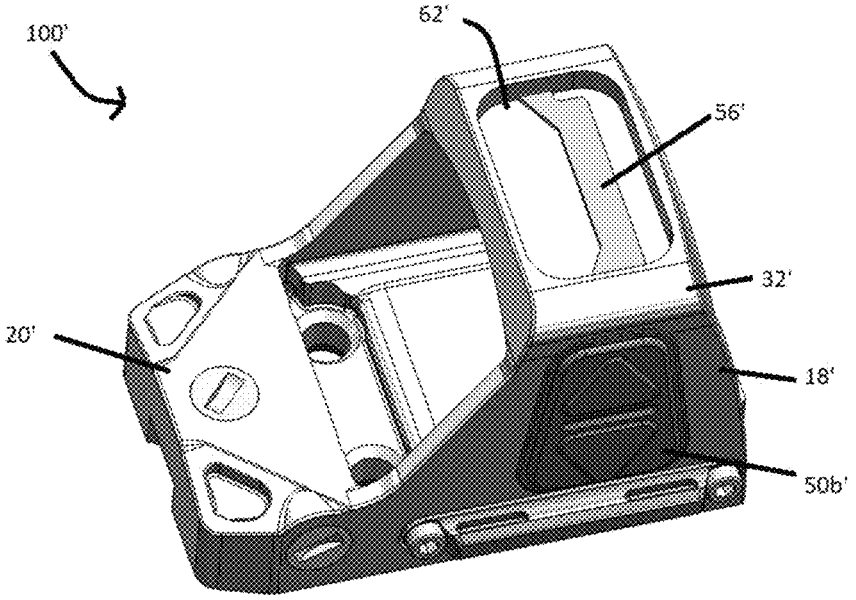
FIG. 5C is a right perspective view of the MRDS of FIG. 5A with the load absorbing/dispersing material removed.
Figure 5D:
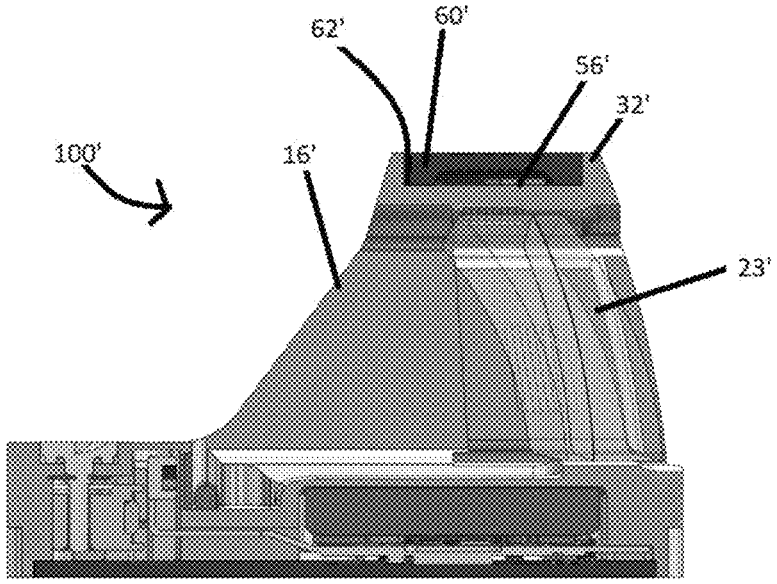
FIG. 5D is a cross-sectional view of the MRDS of FIG. 5B taken along line 5D-5D.
Figure 5E:
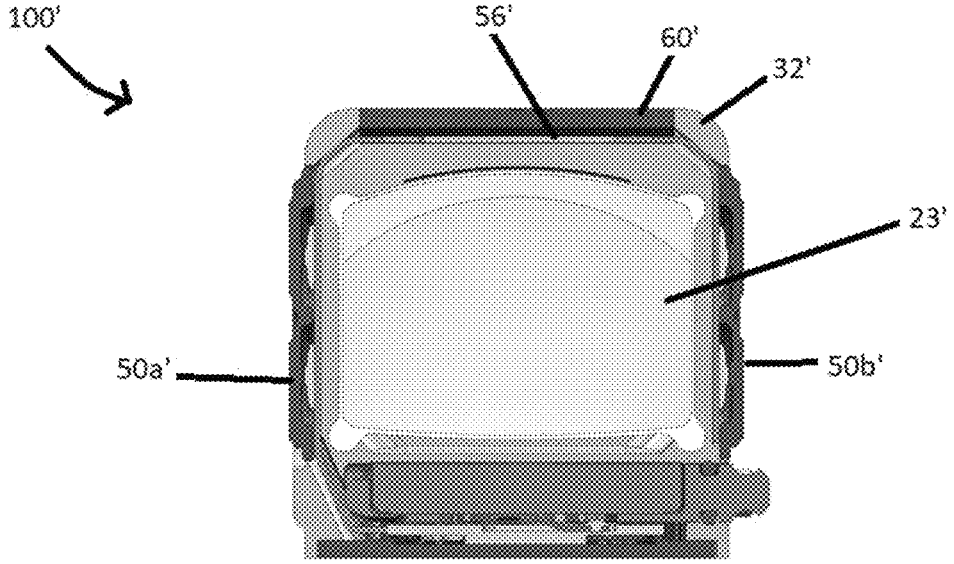
FIG. 5E is a cross-sectional view of the MRDS of FIG. 5A taken along line 5E-5E.

FIG. 5C shows the viewing optic 100' with the load absorbing/dispersing component 60' removed from the recess 62'. The actuation structure 56' is seen and includes an electrically conductive structure which is in communication with the internal mechanisms that control the particular property being adjusted by the controls 50*a*', 50*b*'. That is, activation of a control 50*a*' or 50*b*' causes the actuation structure 56' to send an electrical signal to the internal mechanisms that control the property, which in the described embodiment is brightness. FIGS. 5D and 5E illustrate the internal electrical connections in further detail with the load absorbing/dispersing component 60' in place. Actuation structure 56' extends from the right side 18', across the top side 32' through the recess 62' and under the load absorbing/dispersing component 60', and down the left side 16' to connect with the internal components in the base 20' of the viewing optic 100'. In the embodiment shown, the actuation structure 56' is in contact with a portion of the load absorbing/dispersing component 60'.

Figure 5F:
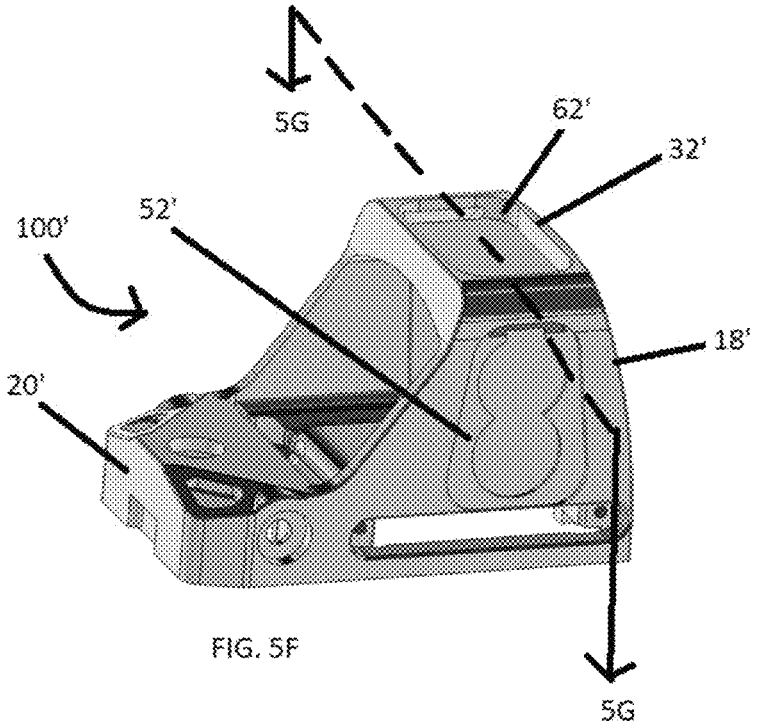
FIG. 5F is a further right side perspective view of the MRDS of FIG. 5A with the load absorbing/dispersing material and actuation members removed.
Figure 5G:
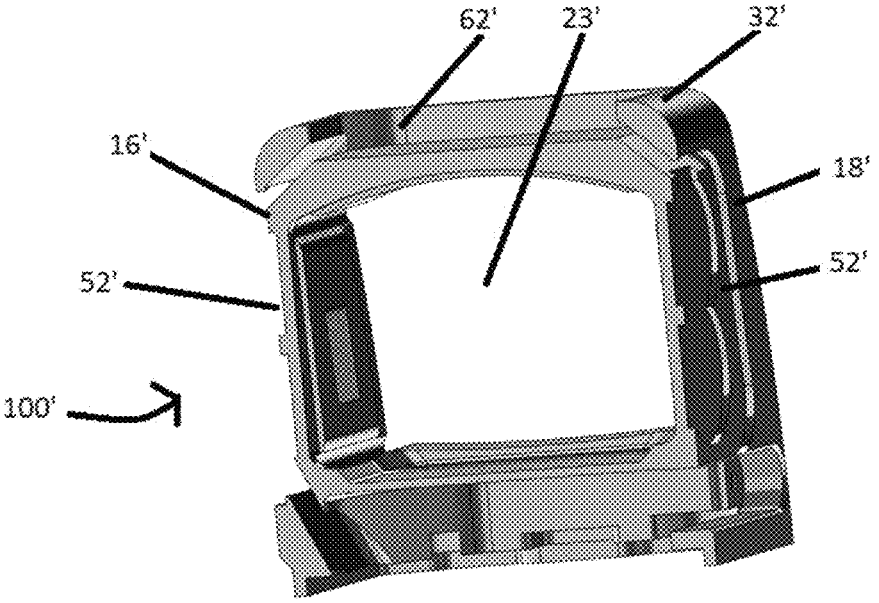
FIG. 5G is a cross-sectional view of the MRDS of FIG. 5F taken along line 5G-5G.

FIGS. 5F and 5G show the viewing optic 100' with the load absorbing/dispersing material 60', actuation structure 56' and controls 50*a*', 50*b*' removed, for clarity.

Figure 6A:
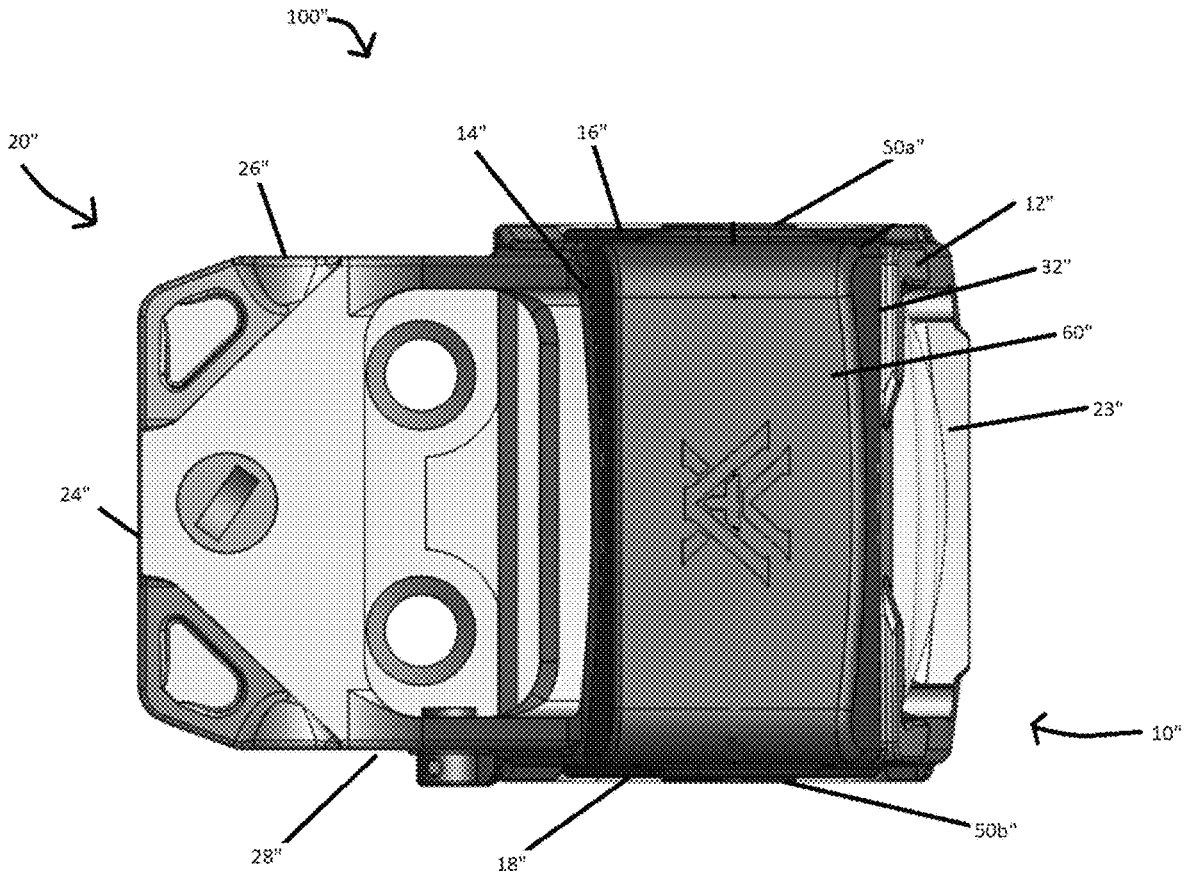
FIG. 6A is a top view of a third embodiment of an MRDS having a load absorbing/dispersing material in accordance with embodiments of the disclosure.
Figure 6B:
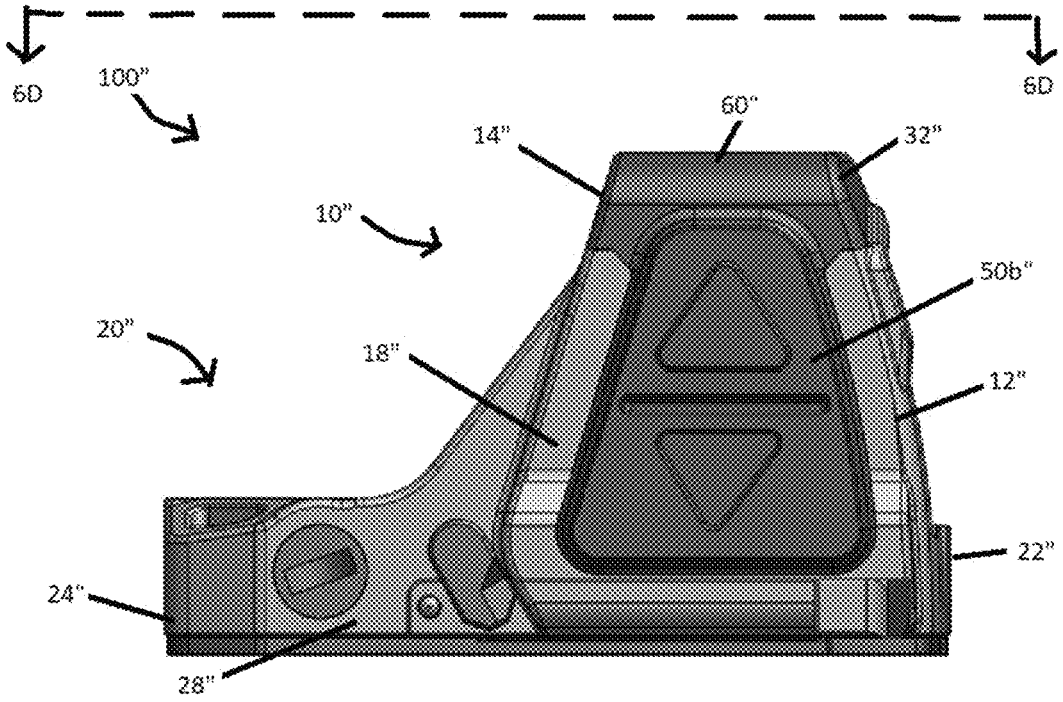
FIG. 6B is a right side view of the MRDS of FIG. 6A.
Figure 6C:
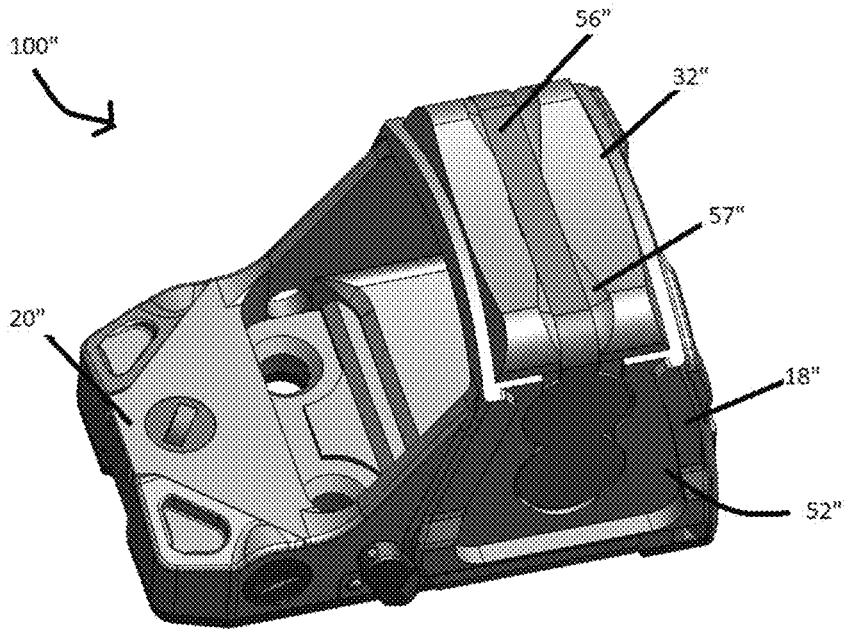
FIG. 6C is a right perspective view of the MRDS of FIG. 6A with the load absorbing/dispersing material removed.
Figure 6D:
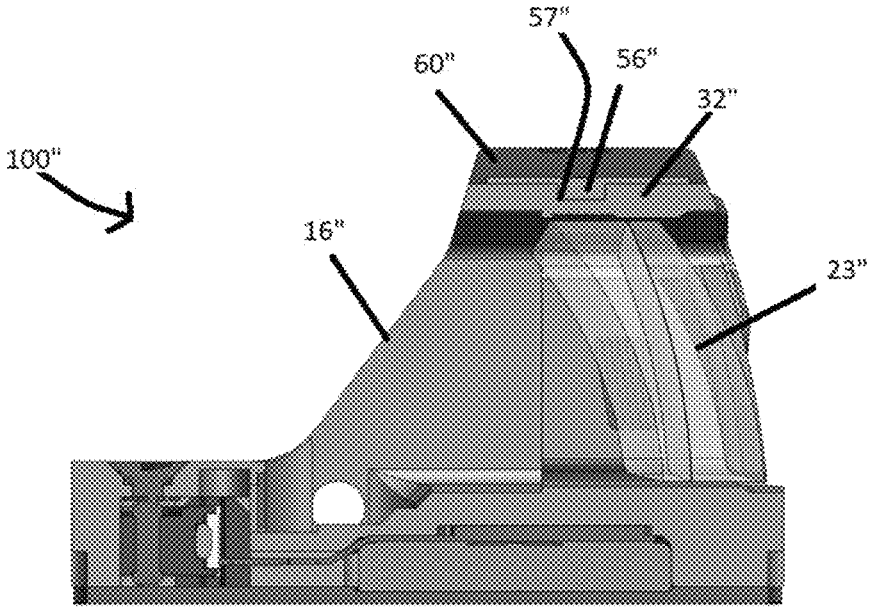
FIG. 6D is a cross-sectional view of the MRDS of FIG. 6B taken along line 6D-6D.

In the embodiment shown in FIGS. 6A-6D, the controls 50*a*" and 50*b*" are similar in design to controls 50*a*' and 50*b*' of viewing optic 100'. As show in FIGS. 6C-6D, an actuation structure 56" extends from the right side 18", across the top side 32" and under the load absorbing/dispersing component 60", and down the left side 16" to connect with the internal components in the base 20" of the viewing optic 100". More specifically, when the actuation structure 56" extends across the top side 32", it passes through a recess 57", in the embodiment a groove or channel. As shown in FIGS. 6A and 6B, the load absorbing/dispersing material 60" covers the recess 57", actuation structure 56" and top side 16", extending partly onto the sides 16" and 18". In the embodiment shown, the actuation structure 56" is in contact with a portion of the load absorbing/dispersing component 60".

Although the mounting system is described with reference to a MRDS, a variety of other viewing optics may be provided with controls on a top surface, as describe herein. As used herein, the term "viewing optic" refers to an apparatus used by a shooter or a spotter to select, identify or monitor a target. The "viewing optic" may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the "viewing optic" device may be unaltered, or it may be enhanced, for example, by magnification, amplification, subtraction, superimposition, filtration, stabilization, template matching, or other means. The target selected, identified or monitored by the "viewing optic" may be within the line of sight of the shooter, or tangential to the sight of the shooter, or the shooter's line of sight may be obstructed while the target acquisition device presents a focused image of the target to the shooter. The image of the target acquired by the "viewing optic" may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method. In one embodiment, the viewing optic is a MRDS, and more particularly an open MRDS.

While various embodiments of the MRDS have been described in detail, it should be apparent that modifications and variations thereto are possible, all of which fall within the true spirit and scope of the invention. With respect to the above description then, it is to be realized that the optimum dimensional relationships for the parts of the disclosed technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A viewing optic comprising:

a base;

a housing comprising a front side, a rear side, a left side, a right side and a top side, wherein the front side, rear side, left side and right side extend upwardly from the base, and wherein the top side extends between upper edges of the front side, rear side, left side and right side, the top side having a recess, the recess having a channel;

a first control on the left side;

a second control on the right side;

an actuation structure that passes from the left side, across the top side through the channel of the recess, and to the right side, the actuation structure in communication with the first control and the second control; and a load absorbing/dispersing component within the recess of the top side, wherein the actuation structure passes under the load absorbing/dispersing component and is in contact with a portion of the load absorbing/dispersing component.

2. The viewing optic of claim 1, wherein the load absorbing/dispersing component comprises at least one load absorbing/dispersing material.

3. The viewing optic of claim 2, wherein the at least one load absorbing/dispersing material is selected from the group consisting of a rubber, a gel, a foam, a plastic, a polymeric material, a non-Newtonian material and combinations thereof.

4. The viewing optic of claim 1, wherein the load absorbing/dispersing component is flush with an upper surface of the top side.

5. The viewing optic of claim 1, wherein the load absorbing/dispersing component extends beyond an upper surface of the top side.

6. The viewing optic of claim 1, wherein the load absorbing/dispersing component at least partially covers an upper surface of the top side.

* * * * *